US006119701A

United States Patent [19]

Cerami et al.

[11] Patent Number: 6,119,701

[45] Date of Patent: Sep. 19, 2000

[54] METHODS, AGENTS AND DEVICES FOR REMOVING NUCLEOPHILIC TOXINS FROM TOBACCO AND TOBACCO SMOKE

[75] Inventors: Anthony Cerami; Carla Cerami, both of New York, N.Y.; Peter Ulrich, Old Tappan, N.J.

[73] Assignee: Cerami Consulting Corp., Tarrytown, N.Y.

[21] Appl. No.: 09/023,569

[22] Filed: Feb. 13, 1998

[51] Int. Cl.[7] ..... A24B 15/00; A24B 15/10

[52] U.S. Cl. ..... 131/331; 131/332; 55/350.1

[58] Field of Search ..... 131/331, 332, 131/335; 55/350.1

[56] References Cited

U.S. PATENT DOCUMENTS

| | | | |
|---|---|---|---|
| 4,187,863 | 2/1980 | Kovats et al. | 131/17 R |
| 4,294,266 | 10/1981 | Sprecker et al. | 131/277 |
| 5,118,681 | 6/1992 | Amick et al. | 514/238.8 |
| 5,706,833 | 1/1998 | Tsugaya et al. | 131/332 |
| 5,850,840 | 12/1998 | Cerami et al. | 131/330 |
| 5,853,703 | 12/1998 | Cerami et al. | 424/53 |

*Primary Examiner*—Stanley S. Silverman
*Assistant Examiner*—Jacqueline A Ruller
*Attorney, Agent, or Firm*—Klauber & Jackson

[57] ABSTRACT

This invention provides methods, devices and agents for the removal of nucleophilic toxins present in tobacco and tobacco smoke, without the removal of nicotine. The filter element of a tobacco smoking device or an air filtration device used in conjunction with a tobacco smoking device may comprise chemical moieties reactive with nucleophilic compounds, or agents that trap nucleophilic compounds may be incorporated into the filter element of tobacco smoking device such as a cigarette, cigar, pipe, or in a separate filter through which tobacco smoke passes before entering the mouth. The agents may also be incorporated into air filters for removing tobacco combustion product toxins from room air. The agents may also be incorporated into smoking or smokeless tobacco to remove toxins.

30 Claims, 4 Drawing Sheets

METHODS, AGENTS AND DEVICES FOR REMOVING NUCLEOPHILIC TOXINS FROM TOBACCO AND TOBACCO SMOKE

FIELD OF THE INVENTION

This invention relates generally to methods, devices and agents for the removal of nucleophilic toxins present in tobacco and tobacco smoke, without affecting nicotine delivery. Nucleophilic toxins are removed by the passage of tobacco smoke or air containing tobacco smoke through a nucleophilic toxin-removing filter device. Agents may also be incorporated into smoking and smokeless tobacco to prevent volatilization and absorption, respectively, of nucleophilic toxins. Dosimetry of nucleophilic tobacco combustion products is used to monitor toxin exposure.

BACKGROUND OF THE INVENTION

Tobacco smoke is a complex mixture which includes numerous chemical compounds and particulates which to a major extent are responsible for both the enjoyment of smoking and the dangers to health in so doing. Use of tobacco products, especially smoking, is associated with increased incidence of lung and other types of cancer, emphysema, and cardiovascular disease. Less lethal adverse effects such as tooth discoloration and facial wrinkling also occur. Among the many compounds present in tobacco smoke are the purported addictive component nicotine, compounds responsible for flavor, and those either proven harmful or believed to be harmful to human health. Tobacco smoke contains chemical toxins such as carbon monoxide and hydrogen cyanide, and known carcinogens such as formaldehyde and hydrazine. Specific compounds in tobacco smoke may fall into more than one of these categories, such as those responsible for flavor. Methods for reducing the exposure of smokers to these toxic compounds without affecting the flavor of smoke while maintaining nicotine delivery has been sought for many decades.

Nicotine is an alkaloid present in tobacco and tobacco smoke and is believed to provide the addictive component. Its long-term effects on health are uncertain; nevertheless, one trend in reducing exposure to the harmful effects of tobacco is to provide smokers with alternative nicotine delivery systems, by inhalation, oral absorption, and transdermally, among other routes of administration.

The harmful effects of tobacco use, and principally cigarette smoking, derive from the delivery to the body of toxic compounds present in tobacco and volatilized during its combustion, as well as those formed as a result of combustion. These include gaseous compounds, such as carbon monoxide, hydrogen cyanide, ammonia, and formaldehyde, and others that are volatilized in tobacco smoke, such as benzene, acrolein, hydrazine, and aniline. Collectively, the solid material which may be condensed from tobacco smoke is known as tar. Several compounds in smoke and tar are classified as carcinogens: benzene, 2-naphthylamine, 4-aminobiphenyl, and the radioactive element polonium-210. Others are considered probably human carcinogens, such as formaldehyde, hydrazine, N-nitrosodimethylamine, N-nitrosodiethylamine, N-nitrosopyrrolidine, benzo[a] pyrene, N-nitrosodiethanolamine, and cadmium. Further compounds in tobacco smoke have been proven to be animal carcinogens. While the carcinogenic potential of these tobacco smoke components has never been tested directly in humans, a cause-and-effect relationship between smoking and the aforementioned adverse effects has been strongly established through epidemiologic studies.

Numerous methods and devices to reduce or remove toxic components from tobacco and tobacco have been proposed and constructed. In general, a porous filter is provided as a first line trap for harmful components, interposed between the smoke stream and the mouth. This type of filter, often composed of cellulose acetate, both mechanically and by adsorption, traps a certain fraction of the tar present in smoke. This type of filter is present on most cigarettes available, yet it allows a significant amount of harmful compounds to pass into the mouth. Epidemiological data connects use of filtered cigarettes with adverse health effects.

An improvement in the effectiveness afforded by a mechanical-type filter such as those described above may be provided by including means for chemically trapping disagreeable and harmful components present in smoke. For example, U.S. Pat. No. 5,076,294 provides a filter element containing an organic acid, such as citric acid, which reduces the harshness of the smoke. A significant body of art focuses on removing formaldehyde, a prevalent component of tobacco smoke with an established and adverse toxicological profile. U.S. Pat. No. 4,300,577 describes a filter comprising an absorptive material plus an amine-containing component which removes aldehydes and hydrogen cyanide from tobacco smoke. U.S. Pat. No. 5,009,239 describes a filter element treated with polyethyleneimine modified with an organic acid, to remove aldehydes from tobacco smoke. U.S. Pat. No. 4,246,910 describes a filter impregnated with alkali ferrate compounds, or activated carbon or alumina impregnated with potassium permanganate, for removing hydrogen cyanide from tobacco smoke. Control of the delivery of tar, nicotine, formaldehyde and total particulate matter was afforded by a filter element containing zinc thiocyanate, sarcosine hydrochloride, zinc chloride, ferrous bromide, lithium bromide, or manganese sulfate, as describe in U.S. Pat. No. 4,811,745. Inclusion of L-ascorbic acid in a filter material to remove aldehydes is disclosed in U.S. Pat. No. 4,753,250. U.S. Pat. No. 5,060,672 also describes a filter for specifically removing aldehydes, such as formaldehyde, from tobacco smoke by providing a combination of an enediol compound, such as dihydroxyfumaric acid or L-ascorbic acid, together with a radical scavenger of aldehydes, such as oxidized glutathione or urea, or a compound of high nucleophilic activity, such as lysine, cysteine, 5,5-dimethyl-1,3-cyclohexanedione, or thioglycolic acid. Such filters, however, have not been shown to reduce the harmful effects of tobacco smoke, and have yet to demonstrate adequate consumer acceptance or commercial viability. Furthermore, many of the agents used in the above-mentioned filters, such as organic acids, will trap nicotine and interfere with its delivery to the smoker.

As used throughout this application, the terms nucleophile and nucleophilic refer to a negative ion or neutral molecule, such as an amino group or primary or secondary amine, that brings an electron pair into a chemical reaction with another molecule or positive ion, called an electrophile which is capable of accepting the electron pair, such as an active carbonyl group. Nucleophilic compounds will chemically react with compounds bearing active carbonyl groups, such as aldehydes, anhydrides, activated ketones, and active esters.

Smokeless tobacco includes tobacco products which are used by methods other than smoking, for instance, as snuff and chewing tobacco. Toxic products present in tobacco also enter the body by these methods of using tobacco which do not involve combustion, and these products are also associated with numerous adverse sequelae of tobacco use.

Contrary to the above-cited prior art in which nucleophilic compounds incorporated in a filter were used to trap aldehyde-type toxins in tobacco smoke, it has been discovered that the nucleophilic toxins present in tobacco and tobacco smoke may be removed from tobacco and tobacco smoke by agents, or filters derivatized with chemical moieties comprising these agents, which chemically trap nucleophilic compounds. Tar, mutagens, and known carcinogens present in tobacco and tobacco smoke may be effectively removed by these agents or filters comprising these agents which chemically traps nucleophilic toxins, without affecting the nicotine and flavor components of smoke. Furthermore, agents which trap nucleophilic toxins may be incorporated into air filters to remove tobacco-derived toxins from room air, to reduce exposure to second-hand (sidestream) smoke.

SUMMARY OF THE INVENTION

The invention described herein provides a method for reducing the level of nucleophilic toxins present in tobacco and tobacco smoke by incorporating agents into the tobacco or passing the tobacco smoke through a filter element comprising agents which chemically react with and trap nucleophilic compounds present in tobacco combustion products, without affecting nicotine delivery. The agents may be admixed with smoking or smokeless tobacco. The filter element may comprise a porous filter matrix wherein the filter matrix bears chemical substituents which trap nucleophiles, or the filter may comprise a porous matrix and one or more agents that chemically trap nucleophiles. Agents with low vapor pressures and high melting points, such as insoluble, polymeric agents, are preferred for use in a smoking device filter. Furthermore, the nucleophile-trapping agents of the present invention may comprise or be incorporated into air filters for removing tobacco combustion product toxins from room air. Non-limiting examples of the types of agents that may be added to tobacco, or that comprise or may be incorporated into the filter of the present invention which traps nucleophiles, but does not trap nicotine, include compounds belonging to the following classes: aldehydes, activated ketones, anhydrides, and active esters. The compound hematein may also be used.

The methods, agents and devices of the present invention, while removing toxic nucleophilic compounds from tobacco and tobacco smoke, do not detract from the flavor of the tobacco product, and, importantly, do not interfere with desired exposure to and absorption of nicotine from the tobacco or tobacco smoke by the user of the product. The agents and devices of the present invention may be used with cigarettes, cigars, pipes, as well as separate filters placed between the tobacco source and the mouth.

For incorporation into smoking tobacco, suitable agents will trap nucleophiles present in the tobacco or formed during burning, and not release them when the agent itself burns, during, for example, the smoking of a cigarette. Agents incorporated into smokeless tobacco must be of acceptable low toxicity and stability to achieve the trapping of nucleophilic toxins while present within the oral cavity or other routes of exposure.

Filters for use in tobacco smoking devices such as cigarettes or separate cigarette filters are contemplated, as well as filters for use in air treatment or filtration systems through which room or ambient air is actively or passively exposed, to remove nucleophilic toxins therefrom. Such filters may range in size from the filter of a cigarette to replaceable filters for commercial or industrial air handling systems.

Suitable filter matrices bearing substituents that may trap nucleophiles may include periodate-oxidized (dialdehyde) derivatives of the polysaccharides cellulose, starch, agarose, and partially-acetylated cellulose; or other polymers, resins or plastics of suitable porosity for use as a tobacco smoke filter and derivatizable with aldehydic moieties. Alternatively, a porous filter element such as a cigarette filter may be prepared which comprises an agent capable of trapping nucleophilic toxins present in tobacco smoke, without affecting nicotine delivery.

Non-limiting example of aldehyde compounds that may be used as the agent in the porous filter or tobacco additive of the present invention include dialdehyde starch, dialdehyde cellulose, adenosine dialdehyde, inosine dialdehyde, O-phthaldialdehyde, aldehyde agarose, and ethylenedioxybis(3-benzaldehyde). Dialdehyde starch is preferred. Activated ketones useful in the practice of the present invention may include α-dicarbonyl compounds, β-dicarbonyl compounds, γ-dicarbonyl compounds, and α,β-unsaturated ketones. As non-limiting examples, α-dicarbonyl compounds may include camphorquinone, ninhydrin, phenylglyoxal, and alloxan; β-dicarbonyl compounds may include 5,5-dimethyl-1,3-cyclohexanedione and dibenzoylmethane; γ-dicarbonyl compounds may include succinylphenone and hydrindantin; and α,β-unsaturated ketones may include 1,2-dibenzoylethylene, curcumin, and dicinnamalacetone.

Non-limiting examples of anhydrides useful for the present invention include 2-dodecen-1-ylsuccinic anhydride, bicyclo(2,2,2)oct-7-ene-2,3,5,6-tetracarboxylic dianhydride, diethylenetriaminepentaacetic dianhydride, ethylenediaminetetraacetic dianhydride, and (+)-diacetyl-1-tartaric anhydride. Non-limiting examples of active esters include N-α-t-butoxycarbonyl-L-alanine-N-hydroxysuccinimide ester, N-α-t-butoxycarbonyl-L-glutamic-α-benzyl ester-γ-N-hydroxysuccinimide ester, ε-t-butoxycarbonyl-aminocaproic acid N-hydroxysuccinimide ester, N-hydroxysuccinimidyl-modified agarose, and 6-aminohexanoic acid N-hydroxysuccinimidyl ester-modified agarose. N-hydroxysuccinimidyl-modified agarose is preferred.

It is another object of the present invention to provide a device for reducing the levels of nucleophilic toxins present in tobacco smoke, without affecting nicotine delivery. The device may comprise a porous filter matrix wherein the filter matrix bears chemical substituents which trap nucleophiles, or the filter may comprise a porous matrix and one or more agents that chemically trap nucleophiles. Agents with low vapor pressures and high melting points, such as insoluble, polymeric agents, are preferred for use in a smoking device. Non-limiting examples of the types of agents that may be used in the filter of the present invention include compounds belonging to the following classes: aldehydes, activated ketones, anhydrides, and active esters. The compound hematein may also be used. Non-limiting examples of agents capable of chemically reacting with and trapping nucleophilic compounds present in tobacco smoke are recited above. Passage of tobacco smoke through the device mechanically and adsorptively removes compounds and particulates, and the agent or moieties chemically react with and trap nucleophilic compounds present in the tobacco smoke.

It is a further object of the present invention to provide a filter material which is capable of reducing the level of nucleophilic toxins present in tobacco smoke passing through the filter, the filter matrix bearing chemical substituents which trap nucleophiles but do not affect the delivery of nicotine. Suitable filter matrices bearing substituents or moieties that may trap nucleophiles include periodate-oxidized (dialdehyde) derivatives of the polysaccharides cellulose, starch, agarose, and partially-acetylated cellulose; or other polymers or plastics of suitable porosity for use as a tobacco smoke filter and derivatizable with aldehydic moieties.

It is yet another object of the present invention to provide an agent that can chemically trap nucleophilic toxins present in tobacco smoke and may be included in a porous filter matrix. Agents with low vapor pressures and high melting points, such as insoluble, polymeric agents, are preferred. Non-limiting examples of the types of agents that may be used in the filter of the present invention include compounds belonging to the following classes: aldehydes, activated ketones, anhydrides, and active esters. The compound hematein may also be used. Non-limiting examples of suitable compounds are recited above.

It is yet another object of the present invention to provide a dosimetry device utilizing the agents of the present invention to provide an indication of the level of exposure to nucleophilic toxins present in the environment.

These and other aspects of the present invention will be better appreciated by reference to the following drawings and Detailed Description.

DETAILED DESCRIPTION OF THE INVENTION

Figure 1:
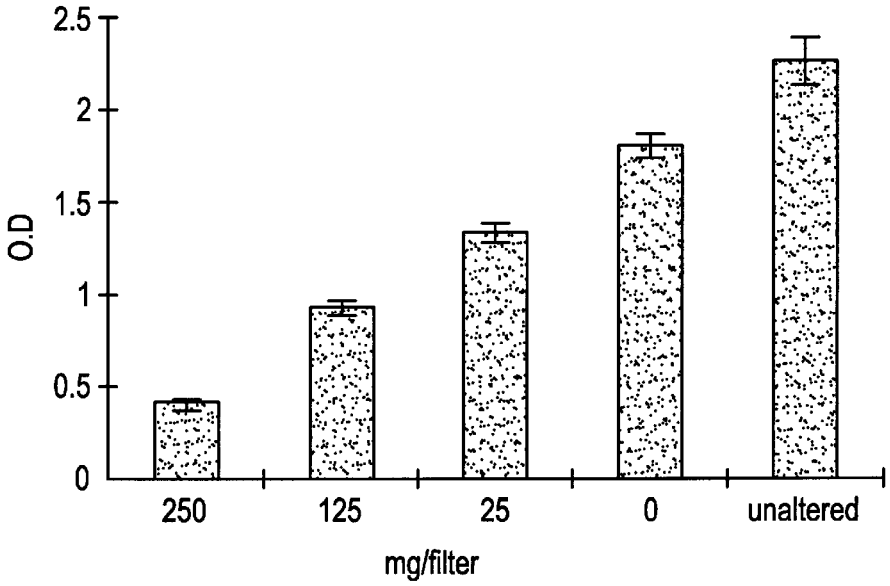
FIG. 1 is a graph depicting a dose response of the removal of tar, measured colorimetrically, from cigarette smoke by an agent and device of the present invention.

Of the numerous components heretofore identified in tobacco believed to contribute to the adverse consequences of smoking, direct toxins, human carcinogens, mutagens, probable human carbinogens and proven animal carcinogens are present. Human carcinogens include benzene, 2-naphthylamine, 4-aminobiphenyl, and the radioactive element polonium-210. Probable human carcinogens, such as formaldehyde, hydrazine, N-nitrosodimethylamine, N-nitrosodiethylamine, N-nitrosopyrrolidine, benzo[a] pyrene, N-nitrosodiethanolamine, and cadmium. Further compounds in tobacco smoke have been proven to be animal carcinogens, including benz[a]anthracene, butyrolactone, N-nitrosonornicotine. Many of the aforementioned compounds are also directly toxic to cells in the body. While the toxicologic, mutagenic and carcinogenic potential of these tobacco smoke components have never been tested by direct experimentation in humans, a strong cause-and-effect relationship between smoking and adverse effects has been established epidemiologically.

Although smoking of tobacco, principally cigarette smoking, but also including cigar and pipe smoking, is strongly linked epidemiologically to the aforementioned adverse sequelae, exposure to smokeless tobacco products, including chewing tobacco and snuff, also carries a risk of developing adverse health effects. Furthermore, smokers are principally exposed to what is termed "mainstream" smoke, i.e, that which is inhaled from the smoking device. However, recent studies have implicated exposure of nonsmoking individuals to what is termed "sidestream" smoke, that which arises from the smoking device itself. The latter exposure has led to significant concern that individuals breathing "second-hand" smoke are at risk for developing the same adverse health consequences that typify smokers. Methods of removing toxic components from tobacco and especially tobacco smoke, from mainstream and sidestream smoke, are desirable in reducing the excessive health care costs associated with the consequences of tobacco and tobacco smoke exposure.

Reduction in exposure of individuals to the toxic components in tobacco and tobacco smoke is desirable, without reducing the enjoyment of using the tobacco products, and especially without reducing the exposure to and absorption of nicotine.

Reduction in exposure of individuals to toxic compounds present in tobacco and tobacco smoke may be achieved by the agents and device of the present invention at several points along the route from the tobacco itself to the point of exposure by the individual. Agents may be added to or blended into the tobacco itself, either smoking or smokeless tobacco, which bind and sequester toxins, not permitting them to be leached or absorbed from the smokeless tobacco or not permitting them to be volatilized into the smoke as the tobacco burns. For smoking tobacco, a second stage of intervention is in removing toxic products from the smoke stream. This may be achieved to some extent by toxin-sequestering agents added to the tobacco itself, which before burning acts itself as a filter. More useful is a filter placed between the column of combusting tobacco and the mouth, or in a separate device, through which the smoke passes before entering the body. By mechanical and adsorptive properties, present filters remove particulates, tar, and other components from the smoke. At a further stage, exhaled tobacco smoke or sidestream smoke produced from the burning smoking device and present in the environment may be filtered of toxins by passing ambient room air through or in contact with a material or filter which removes toxins.

As described above, porous, fibrous smoke filters remove a portion of these toxic compounds by mechanical trapping and adsorption to the fibrous surface. Nevertheless, toxic compounds remain in the inhaled smoke and contribute to enormous morbidity and mortality, mainly lung and other cancers, other lung diseases such as emphysema, and cardiovascular disease including heart attack and stroke. Numerous theories exist relating various pathophysiological disease processes with specific tobacco smoke components. It is apparent from this body of work that tobacco smoke contains toxins which are incompatible with health, and that reduction of the exposure to the body of these toxins is prudent. Except for abstaining from smoking and perhaps altering genetically the components in the tobacco leaf, reduction in exposure of the smoker to tobacco smoke toxins may be achieved only by adding toxin-sequestering agents to the tobacco or selectively removing toxins from the smoke before inhalation.

On the other hand, it is desirable to not affect the level of nicotine present in tobacco smoke nor reduce the enjoyment of using tobacco products in accordance with the objects of the present invention. While the long-term health consequences of nicotine are unknown, it is believed to provide the addictive properties of tobacco usage. Some alternatives to cigarette smoking are nicotine delivery devices such as cigarette-like devices that deliver volatilized nicotine, chewing gum containing nicotine, and transdermal patches which deliver nicotine across the skin.

With the identification of significant amounts of the suspected carcinogen formaldehyde in cigarette smoke, considerable effort has been expended by others on developing chemical trapping methods for removing formaldehyde from smoke, mainly by including an aldehyde-trapping chemical in the filter. This may be achieved by the inclusion of nucleophilic compounds in the filter, such as those containing amino groups, as cited in the Background section above. Organic acids and enediols of the prior art would also undesirably remove nicotine (for example, U.S. Pat. No. 4,753,250). Examples described above of filters incorporating nucleophilic compounds such as lysine apparently have not achieved their desired effect as they have not been commercially introduced.

It was found surprisingly and unexpectedly by the inventors herein that a significant reduction in the level of mutagens and tar present in tobacco smoke may be achieved without reduction in the nicotine level or enjoyment of the product by the use of a filter which in addition to providing a mechanical porous barrier, also traps nucleophilic compounds present in tobacco smoke. Nucleophilic compounds present in tar and tobacco smoke include hydrazine and the aromatic amines 4-aminobiphenyl, 2-naphthylamine, and aniline, among other compounds. The aforementioned smoke components are known mutagens and known or suspected carcinogens. Filter materials capable of trapping nucleophilic toxins from tobacco smoke include a filter in which the filter matrix material bears nucleophile-trapping groups, such as aldehydic groups; alternately, one or more agents capable of trapping nucleophiles may be incorporated into the filter matrix. These toxins may also be removed by incorporating suitable, nucleophile-trapping agents directly into the tobacco, and furthermore, these toxins may be removed from smokeless tobacco products by incorporating suitable nucleophile-trapping agents in the smokeless tobacco product.

It is important to distinguish the intent of the nucleophilic-trapping methods, agents and devices of the present invention, which for example comprise aldehydic groups on a filter material, from the significant body of prior art in which nucleophilic substances, such as aldehydes, were desirably removed from tobacco smoke by filters comprising nucleophiles. The present invention is essentially the reverse of the prior art. As an example encompassing the prior art, aldehydes in smoke were trapped by amino groups in or on filters; in the present invention, amines in the tobacco smoke are trapped by aldehydes in or on the filters. Nicotine, being a tertiary amine, is not trapped by the agents or devices of the present invention.

Suitable filter matrices bearing substituents that may trap nucleophiles may include periodate-oxidized (dialdehyde) derivatives of the polysaccharides cellulose, starch, agarose, and partially-acetylated cellulose; or other polymers, resins or plastics of suitable porosity for use as a tobacco smoke filter and derivatizable with aldehydic moieties.

Agents that may be incorporated into a filter matrix capable of trapping nucleophilic compounds may be selected from aldehydes, activated ketones, anhydrides, and active esters. The compound hematein may also be used. Compounds are preferably of low vapor pressure in order to remain within the filter and not become volatilized on exposure to a stream of heated air and tobacco smoke. An insoluble, polymeric nucleophile-trapping agent is preferred.

Suitable compounds for incorporation directly into smoking and smokeless tobacco products comprise those suitable for the intended purpose. For smokeless tobacco products, suitable agents must have a toxicological profile compatible with the extent of exposure to the individual, and furthermore not interfere with the taste, flavor, or enjoyment of the product. Compounds should be of low toxicity and preferably not absorbed. For incorporation into smoking tobacco to sequester nucleophilic toxins in the tobacco and that formed upon burning, the agents must not interfere with the flavor or enjoyment of the product, the rate of combustion of the smoking product either during or between inhalation, and not release the sequestered toxin when the agent within the tobacco is burned. Nucleophilic-binding agents present in the tobacco act in part like a porous filter material for smoke passing through the as-yet unburned portion of the tobacco column. The presence of the toxin-removing material should not interfere with the draw, or resistance to passage of air and smoke, through the tobacco column or filter.

Non-limiting examples of aldehyde compounds that may be used in the present invention include dialdehyde starch, dialdehyde cellulose, adenosine dialdehyde, inosine dialdehyde, O-phthaldialdehyde, aldehyde agarose, and ethylenedioxybis(3-benzaldehyde). Dialdehyde starch is preferred. Activated ketones may include α-dicarbonyl compounds, β-dicarbonyl compounds, γ-dicarbonyl compounds, and α,β-unsaturated ketones. As non-limiting examples, α-dicarbonyl compounds may include camphorquinone, ninhydrin, phenylglyoxal, and alloxan; β-dicarbonyl compounds may include 5,5-dimethyl-1,3-cyclohexanedione and dibenzoylmethane; γ-dicarbonyl compounds may include hydrindantin and succinylphenone; and α,β-unsaturated ketones may include 1,2-dibenzoylethylene, curcumin, and dicinnamalacetone.

Non-limiting examples of anhydrides useful in the present invention include 2-dodecen-1-ylsuccinic anhydride, bicyclo(2,2,2)oct-7-ene-2,3,5,6-tetracarboxylic dianhydride, diethylenetriaminepentaacetic anhydride, ethylenediaminetetraacetic dianhydride, and (+)-diacetyl-1-tartaric anhydride. Non-limiting examples of active esters include N-α-t-butoxycarbonyl-L-alanine-N-hydroxysuccinimide ester, N-α-t-butoxycarbonyl-L-glutamic-α-benzyl ester γ-N-hydroxysuccinimide ester, ε-t-butoxycarbonyl-aminocaproic acid N-hydroxysuccinimide ester, N-hydroxysuccinimidyl-modified agarose, and 6-aminohexanoic acid N-hydroxysuccinimidyl ester-modified agarose. N-hydroxysuccinimidyl-modified agarose is preferred.

Prior uses of aldehydes in tobacco smoking articles has been limited to the inclusion of aldehyde compounds as aroma or flavor modifiers. The compounds n-hexenal, n-octanal, n-nonenal, n-decanal, n-tetradecanal, n-heptanal, n-undecanal, and n-dodecanal were incorporated into the tobacco or filter material in accordance with U.S. Pat. No. 4,627,449, in order to improve the aroma and taste of the tobacco smoke and particularly the aroma of sidestream smoke, i.e., the smoke which passes from the burning tobacco directly to the environment. These compounds are volatilized from the tobacco into the smoke to mask the adverse odors of burning cigarettes. Their vapor pressures make them unsuitable for use in the present invention as they would be volatilized and lost from the filter and unable to trap nucleophiles from tobacco smoke.

The preferred agent of the present invention is dialdehyde starch. Also known as oxidized starch or polymeric dialdehyde, it is prepared by the periodate oxidation of starch, which produces free aldehyde groups that may react with nucleophiles such as alcohols, amines, hydrazines, hydrazides, and other reagents that condense with aldehydes. Dialdehyde starch may be obtained from any of a number of chemical suppliers, such as Sigma Chemical Company (Catalog No. P9265) or a manufacturer, Monomer-Polymer & Dajac Laboratories, Inc.

Dialdehyde starch has been used previously for other applications, such as for increasing the wet strength of paper, such as tissue paper, for hardening gelatin, for making water-resistant adhesives, and for tanning leather. In enzyme studies, dialdehyde starch has been used to aid in the attachment of proteins to polymer surfaces, by chemically reacting with hydroxyl groups of a polymer films. It was further used directly as a polymer surface-modifying agent in U.S. Pat. Nos. 5,281,660 and 5,563,215 to enable biologically active molecules and subsequently cells to bind to the modified surface without altering the biological properties of the molecules. Moderate heat treatment (50° C. to 150° C.) was necessary in order for the dialdehyde starch to bind to the polymer surface.

Other agents suitable for the practice of the present invention may be selected from polymers such as agarose (e.g. SEPHAROSE(R)), cellulose, chitosan, dextran (e.g., SEPHADEX(R)), polyvinylpyrrolidone, and the like, which may be chemically derivatized to provide free nucleophile-trapping groups. For example, agarose may be derivatized to contain N-hydroxysuccinimidyl groups, such as Sigma Chemical Co. Catalog No. H8635, N-hydroxysuccinimidyl-activated SEPHAROSE(R) or Catalog No. A9019, 6-aminohexanoic acid N-hydroxysuccinimide ester coupled to SEPHAROSE(R), Aldehyde-agarose (Sigma Chemical Co. Catalog No. A9951) may also be used; one method of preparation involves derivatization of agarose with 4-aminobutyraldehyde diethyl acetal, and subsequent mild acid hydrolysis of the acetal to generate the aldehyde (Korpela and Hinkkanen, 1976, Analytical Biochem. 71:322–323).

The insoluble polymers recited above may also be used directly as the filter material of the present invention.

The device of the present invention may be prepared by any one of several methods known to the skilled artisan wherein the toxin-removing agent or agents are incorporated into an air filter or tobacco smoke filter at any of a number of stages in the manufacturing process. For example, an agent or agent so the present invention may be mixed with the raw material comprising the mechanical filter and then co-extruded or spun to form fibers comprising filter material and the toxin-removing agent, which may then be made into filters. Alternatively, extruded or spun fibers comprising the filter material may be coated with a molten agent or agents of the present invention, or a solution of the agent or agents in a suitable solvent, prior to the manufacture of the filters. In another process, the agent may be dissolved or suspended in a plasticizer and they sprayed onto the filter fibers. In another example, the filter devices of the present invention may be prepared from existing mechanical filters by preparing a solution or suspension of the agent or agents in a solvent, absorbing the solvent into the porous filter material, and then removing the solvent by evaporation, drying, freeze-drying, lyophilization, critical point drying, or another suitable method. The filter material would retain its mechanical properties as a barrier to particulate materials and an extensive surface to which tar may be adsorbed.

In another embodiment, the filter material itself, for example, cellulose acetate, may be prepared and chemically derivatized to contain aldehyde groups, following standard methods. For example, cellulose may be partially acetylated or a certain percentage of the acetate groups on cellulose acetate may be hydrolyzed by treatment at high pH. The resulting partially-acetylated cellulose then may be subjected to periodate oxidation. Thus, the cellulose acetate may retain its fibrous and porous filter characteristics while also bearing aldehyde substituents capable of trapping nucleophilic toxins in tobacco smoke. Other polysaccharides with filter-like properties, such as cellulose, agarose, and the like may also be periodate treated to produce free aldehyde groups. Other polymers including plastics may also be chemically derivatized to produce aldehydic substituents. Preferably, the filter material will retain its mechanical filtration properties, by providing a mechanical barrier and extensive surface area to which tar may be adsorbed, in addition to its nucleophile-binding activity.

For use in industrial or commercial air handing systems, air filters available for these systems to filter particulates and other air contaminants may be prepared which also contain an agent or agents of the present invention; alternatively the filter material itself may be derivatized or be prepared from an agent of the present invention, such that the air filter retains its mechanical filtration properties and in addition has the ability to remove nucleophilic toxins from the air. Similar filters or replaceable filter cartridges may be prepared for smaller units, such as those used to filter or purify the air in a single room or shared air space, automobile, bus, train, car, aircraft passenger compartments, racetracks, gambling and off-track betting parlors, bars, saloons, and similar areas in which tobacco products, especially smoking tobacco products, are used, and in some instances in which exposure to sidestream smoke is of particular concern to nonsmokers present therein. A personal air filtration system, similar in construction to a gas mask or face mask, may also be prepared using a filter device of the present invention, for individuals in proximity to such areas but seeking personal protection from the harmful effects of sidestream smoke.

While the inventors do not wish to be bound by theory, the observation that aldehyde and other agents which chemically react with nucleophiles remove tar from tobacco smoke as will be seen in the following examples suggests that a significant portion of the toxic, mutagenic, and carcinogenic compounds present in tobacco smoke are nucleophiles. Of the established carcinogens known to be present in tobacco smoke, 4-aminobiphenyl, 2-naphthylamine, aniline, and hydrazine have primary amino groups. Interestingly, nicotine, which is not desired to be removed from tobacco smoke by the methods, agents and devices of the present invention, does not have a hydrogen-bearing amino group that may form a stable adduct with an aldehyde. Any reduction which may occur is theoretically a result of the mechanical removal (adsorption and filtration) of nicotine from smoke. The data empirically show that the materials of the present invention also remove N-nitrosamines, but the mechanism of removal is not presently known. One would also reasonably expect that filter agent of the present invention would also remove hydrogen cyanide, which would react with the aldehyde groups to form cyanohydrins.

The filter agent of the present invention would not be expected to remove aldehydes from tobacco smoke, such as formaldehyde, unless the compounds also possess a group which may be trapped by an aldehyde. However, trapping of amines by the filter agent of the present invention may produce new functional groups which may then be capable of absorbing, trapping, and chemically inactivating aldehydes and nitrosamines.

It is another object of the present invention to provide a dosimetry device utilizing the agents of the present invention to provide an indication of the level of exposure of the device to nucleophilic toxins present in the environment. The device may be useful to individuals who work or live in an environment in which nucleophilic toxins such as those produced from tobacco smoke may permeate the air, and such individuals wish to gauge their exposure to such toxins. The device may also be useful to determine the proper time to change a filter used to remove nucleophilic toxins from the air. In one embodiment, the dosimeter is in the form of a wearable badge on which a disk or patch comprising an agent of the present invention is coated or therein incorporated. As the badge is exposed to environmental nucleophilic toxins, they chemically react with and adhere to the agent on the disk. As the nucleophilic toxins from tobacco smoke are brown-pigmented, the disk will darken in color with increasing exposure to nucleophilic toxins. A color comparison region on the dosimeter may be used to match the color and read out the level of exposure, based on a predetermined relationship between the disk color and toxin exposure. Other reagents may be included in the device to enhance color production as nucleophilic toxins bind to the agent. In an another embodiment, a dosimeter device may comprise an air-collecting system, such as a pump or fan, which continually or upon activation introduces ambient air into one end of a transparent, graduated, open-ended column filled with a porous filter material containing the agent of the present invention. Toxins present in the introduced air sample bind to the agent, initially proximally to the end of the column at which the air sample is introduced, and then, as the chemically reactive sites on the filter become bound with the toxin, additional toxin binds further along the column containing the agent, distally from the end of introduction. Because the nucleophilic toxins are pigmented, the length of the column of pigmented material present in the column, visually read from the column graduations, will indicate the amount of toxin present in the air. The graduations may be precalibrated depending on the rate of air sampling and the efficiency of sequestering pigmented toxins at the rate of air flow through the column. In a further embodiment, the amount of nucleophilic toxin bound to the agent within a dosimeter device may be determined by reflectometry to determine pigment color density, or by another detector means known to the skilled artisan for determining color density or chemical derivatization. An automated device may provide an analog or digital read-out of the ambient toxin level as a monitor of environmental quality, or be present to indicate when a certain toxin level has been reached, for the purpose, for example, of indicating when a toxin-removing air filter should be replaced with a fresh filter.

The column configuration of the agent and filter material of the present invention as described in the dosimeter embodiment may also be used to determine the amount of filter material necessary to effectively remove nucleophilic toxins from a particular smoking device, in order to assist in the manufacture of smoking devices with reduced nucleophilic toxins in the smoke. By drawing tobacco smoke through a calibrated column containing the nucleophilic toxin-binding agent of the present invention, the resulting length of pigmented filter agent represents the amount of toxins present, and indicates the amount of filter material that must be incorporated into a cigarette filter, for example, in order to effectively remove toxins from the amount of tobacco present in the smoking device.

The agents and filter material of the present invention may also be used to measure the level of nucleophilic toxins present in smoking or smokeless tobacco and other materials by using the agents and filter materials of the present invention in a dipstick format. A predetermined amount of porous filter material comprising an agent of the present invention may be immersed in a suspension or extract of tobacco leaves, extracted cigarette filters, or another solution suspected of containing pigmented nucleophilic toxins in need of quantitating. After removal, the color intensity of the dipstick may be compared visually to known standards or electronically, by reflectometry, to a pre-established standard curve, to display the toxin level.

The following examples are presented in order to more fully illustrate the preferred embodiments of the invention. They should in no way be construed, however, as limiting the broad scope of the invention.

EXAMPLE 1

Removal of Tar from Tobacco Smoke Measured Colorimetrically

Cigarette smoke was filtered through 250 mg portions of each of the compounds listed in Table I. In order to achieve adequate draw with filters made from dialdehyde starch and oxidized starch, these compounds were deposited onto cellulose acetate fibers which had been spread out into swatches 0.25 by 3 inches. The treated fibers were then dried overnight at 37 C. The smoke from one cigarette was drawn through the filter material and then through 3 mls of distilled water using a water-pipe smoking device which was constructed from a 25 ml glass Erlenmeyer flask attached to a vacuum source with an air flow rate of approximately 35 ml/min. Three 100 ul aliquots were removed from each flask, placed into ELISA plate wells and read in an ELISA plate reader at 405 nm. The percentage or tar removed is based on a comparison between the cigarette comprising the filter containing the test agent and an appropriate control cigarette. The results are presented in the table below:

| COMPOUND | % TAR REMOVAL |
|---|---|
| Dialdehyde starch | 92.3 |
| Oxidized starch | 93 |
| Camphorquinone | 53.9 |
| Ninhydrin | 83 |
| Phenylglyoxal | 53 |
| Hematein (6a,7-dihydro-3,4,6a,10 tetrahydroxyben[b]indeno[1,2-d]pyran-9(6H)-one) | 48.7 |
| O-phthaldialdehyde | 84 |
| (5,5-dimethyl-1,3-cyclohexanedione | 26 |
| Hydrindantin | 95 |
| Hydrindantin | 95 |
| Alloxan | 96.9 |
| N-α-t-BOC-L-alanine-N-hydroxysuccinimide ester | 25 |
| Fumarophenone | 87.5 |
| Ethylene dioxy bis (3-benzaldehyde) | 19.3 |
| N-a-t-BOC-L-glutamic-a-benzyl ester-γ-N-hydroxysuccinimide ester | 96.7 |
| BOC-ε-aminocaproic acid-N-hydroxysuccinimide ester | 74 |
| Curcumin | 97.9 |
| Dicinnamalacetone | 98.1 |

-continued

| COMPOUND | % TAR REMOVAL |
|---|---|
| 2-Dodece-1-ylsuccinic anhydride | 98.2 |
| Bicyclo(2,2,2)Oct-7-ene-2,3,5,6-tetracarboxylic dianhydride | 98.2 |
| Ethylenediaminetetraacetic dianhydride | 98.2 |
| (+)-Diacetyl-1-tartaric anhydride | 32.1 |

To demonstrate the dose-response effect of increasing amount of an agent of the present invention in removing tar from tobacco smoke, cellulose acetate filter fibers were spread out into a swatch 0.25 inches by 3 inches and then coated with the following amounts of dialdehyde starch suspended in distilled water: 250 mg, 125 mg, 25 mg and 0 mg. The treated fibers were dried at 37 C overnight and then made into a tobacco cigarette using a tube cigarette maker. The smoke from 1 of each type of filter cigarette was then drawn through 3 mls of distilled water using a water-pipe smoking device which was constructed from a small (25 ml) glass Erlenmeyer flask attached to a vacuum source with an air flow rate of approximately 35 ml/min. Three 100 ul aliquots were removed from each flask, placed into ELISA plated wells and read in an ELISA plate reader at 405 nm.

As shown in FIG. 1, increasing amounts of dialdehyde starch resulted in an increased effectiveness of removal of tar from the tobacco smoke.

EXAMPLE 2

Removal of Tar from Tobacco Smoke Measured Gravimetrically

Cellulose acetate filter fibers were spread out into a swatch 0.25 inches by 3 inches and then coated with the following amounts of dialdehyde starch suspended in distilled water: 250 mg, 125 mg, 100 mg, 50 mg, 25 mg and 0 mg. The treated fibers were dried in a 37 C oven overnight and then made into a tobacco cigarette using a tube cigarette maker. The smoke from five of each type of filter cigarette was then drawn through 5 mls of acetone using a water-pipe smoking device which was constructed from a small (25 ml) glass Erlenmeyer flask attached to a vacuum source with an air flow rate of approximately 35 ml/min. After the cigarettes were burned the 5 mls of tar containing acetone was removed from each of the flasks and absorbed onto a pre-weighed disc of filter paper. Each flask was then rinsed with 1 ml of additional acetone two times. Acetone from the rinses was also absorbed onto the appropriate filter paper discs. Filter discs were dried overnight and then weighed. The original pre-weight of the individual filter discs was subtracted from the final weight of the individual filter discs to obtain the number of milligrams of tar obtained from each of the filter cigarettes, and the results are expressed as percent of tar removed.

Figure 2:
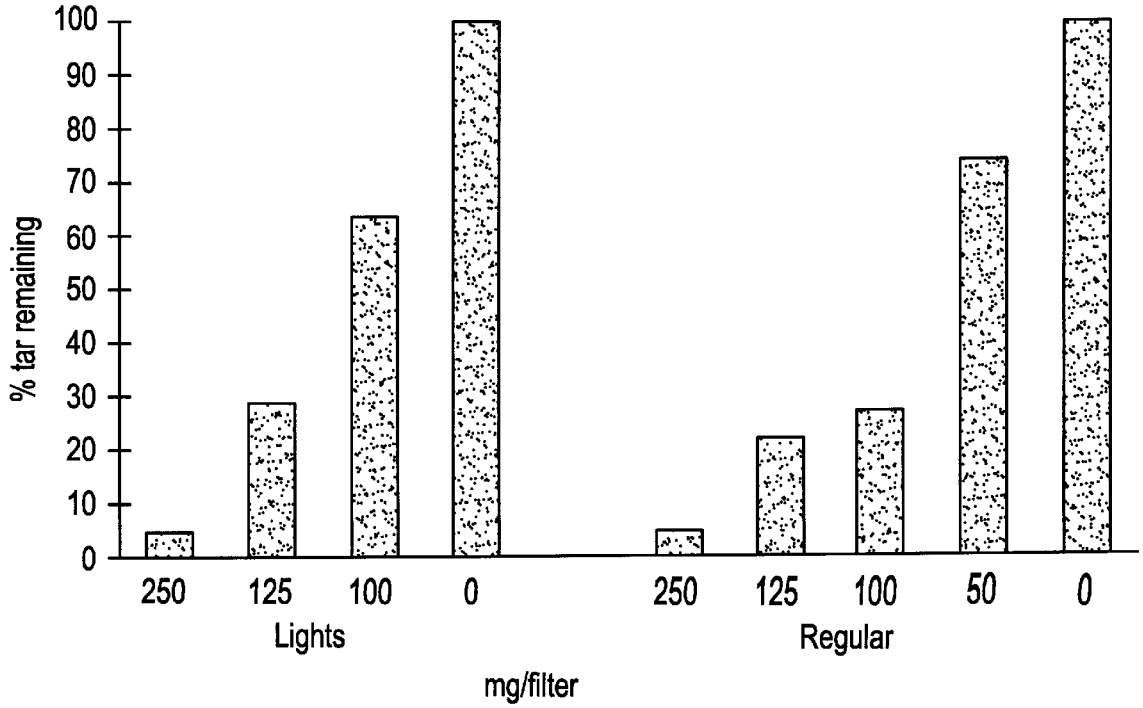
FIG. 2 is a graph depicting a dose response of the removal of tar, measured gravimetrically, from smoke from two different types of cigarettes by an agent and device of the present invention.

FIG. 2 indicates that filters containing an agent of the present invention can remove over 90% of the tar from both "light" and "regular" tobaccos. If over 250 mg/filter is used, tar is still removed, but the "drag" may be judged too difficult by the typical smoker.

EXAMPLE 3

Selective Removal of Tar and Retention of Nicotine

The tar removal assessment was performed exactly as described in Example 2 ("regular" cigarette tobacco was used). For the nicotine analysis, the filters were prepared using the same procedure, one of each type of cigarette was then smoked into 3 mls of distilled water. A 1:10 dilution of smoke extract solution was then analyzed by isocratic HPLC for the presence of nicotine as described in Roche et al., J. Liquid Chromatography 14(15) 2919–2936, 1990.

Figure 3:
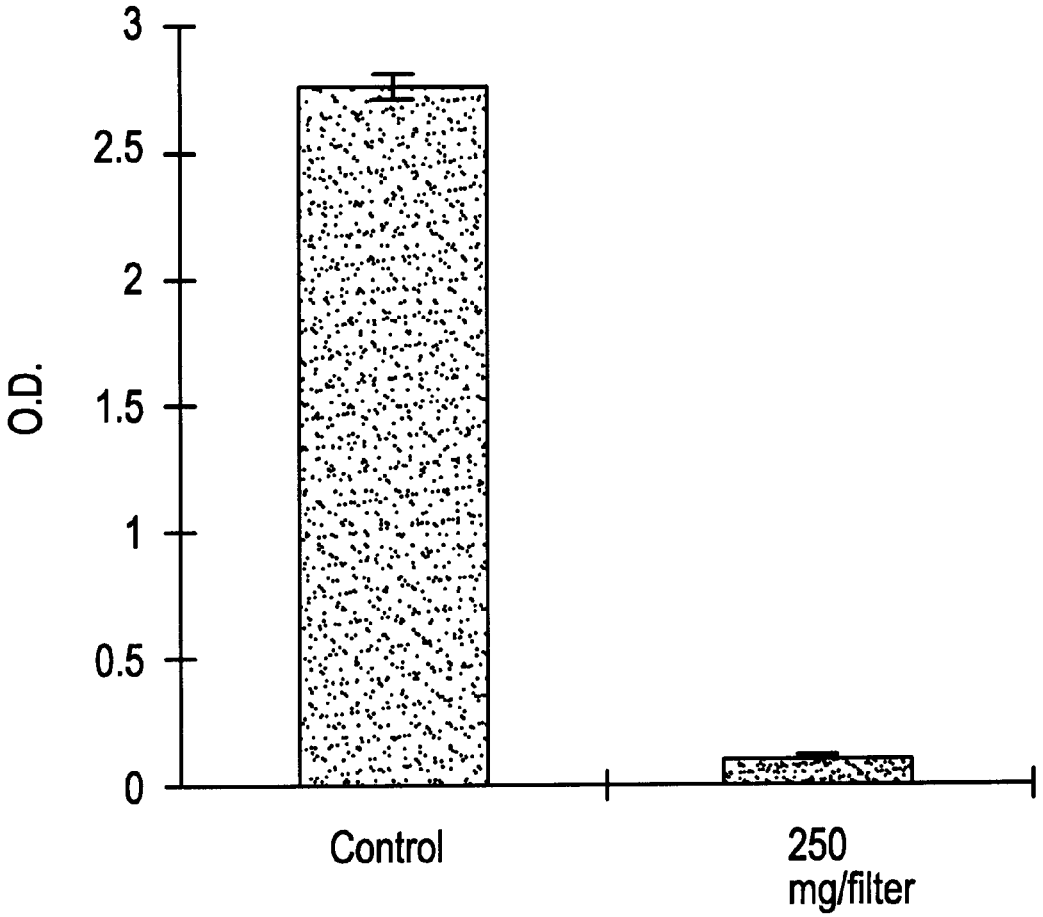
FIG. 3 depicts the selective removal of tar and not nicotine by an agent and device of the present invention.

FIG. 3 shows that increasing amounts of dialdehyde starch removed increasing amounts of tar from tobacco smoke, yet the level of nicotine was affected by less than 10%. At the 250 mg level, over 90% of the tar was removed.

EXAMPLE 4

Removal of Staining Pigments from Tobacco Smoke

Figure 4:
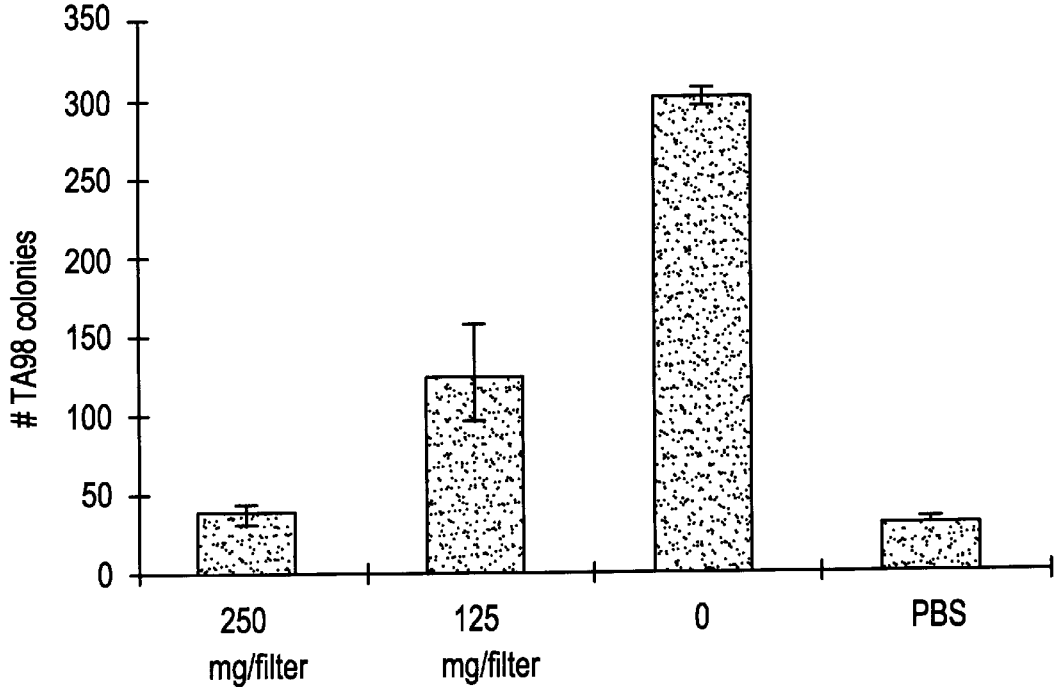
FIG. 4 depicts the removal of staining pigments from tobacco smoke by an agent and device of the present invention.

Cellulose acetate filters were spread out into swatches of 0.25 inches by 3 inches and then coated with 250 mg or 0 mg of dialdehyde starch suspended in distilled water. The treated fibers were then dried in a 37° C. oven overnight and then made into a tobacco cigarette. The smoke from 2 of each type of cigarette was drawn into 1 ml of Phosphate Buffered Saline and the placed immediately on ice. Each sample was then applied to ELISA plate wells coated with 5% non-fat milk (100 ul/well). Plates were incubated for 3 days @37° C. and then washed four times with 0.05% Tween/PBS. Pigments which remained bound to the wells were then solubilized in 100 ul DMSO. Absorbance was then read at 405 nm. Results in FIG. 4 show the average of three wells±standard deviation.

EXAMPLE 5

Removal of Mutagens from Tobacco Smoke

A bacterial mutagenicity assay was performed as described by Ames et al. (Maron D M and Ames B N. 1983. Revised methods for the Salmonella mutagenicity assay. Mutation Research 113:173–215). Briefly, Salmonella strain TA98 was cultured overnight at 37 C in Oxoid nutrient broth #2, incubated with serial dilutions of cigarette smoke condensate from the following filter cigarettes: 250 mg dialdehyde starch/filter, 125 mg dialdehyde starch/filter, and 0 mg/filter diluted in 0.1 M sodium phosphate, pH 7.4 containing 33 mM KCl, 8 mM $MgCl_2$, 5 mM glucose-6-phosphate, 500 uM NADP and rat liver S9 microsomal nucleases, in triplicate for 30 minutes at 37 C. The bacteria were then plated on minimal glucose plates. After a 48 hour incubation period at 37 C, the number of revertant mutants on each plate was counted. Each bar in the graph represents the average number of colonies on three plates±standard deviation. Tester strain TA 98 detects frameshift mutations, such as those generated by aromatic primary amines. Mutagens in the sample are detected as the number of bacteria induced to revert to their wild-type phenotype.

Figure 5:
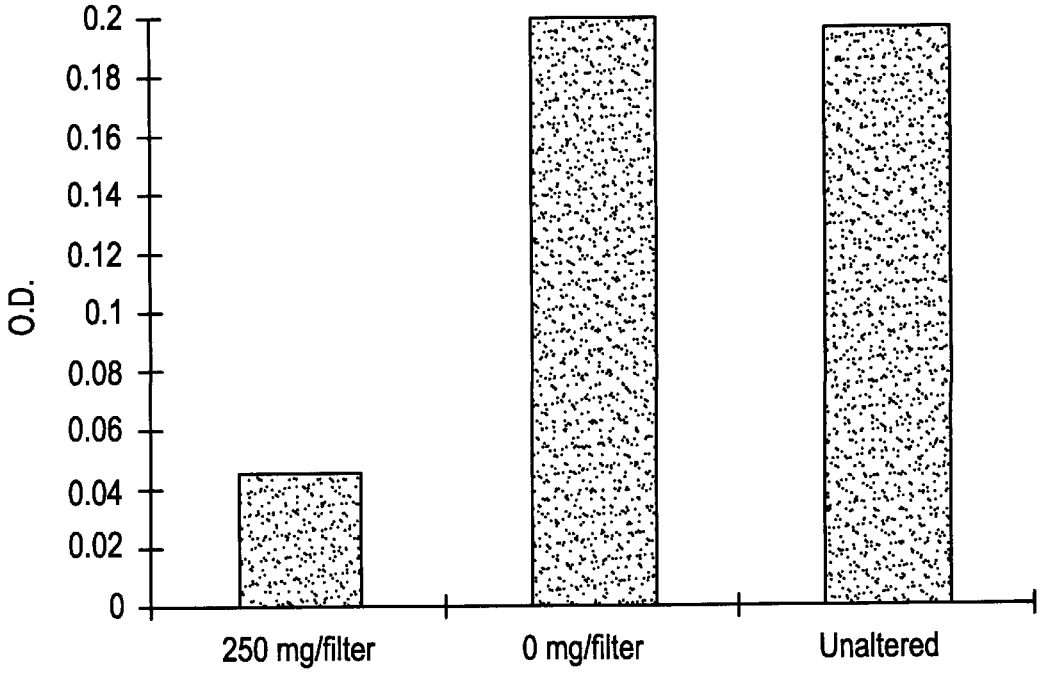
FIG. 5 depicts a dose response of the removal of mutagens from tobacco smoke by an agent and device of the present invention.

FIG. 5 shows that increasing amounts of dialdehyde starch present in the cigarette filter result in a decrease in the mutagenicity of the smoke extract. Using the 250 mg filter, the number of revertants was no different than the negative control.

EXAMPLE 6

Removal of Nitrosamines from Tobacco Smoke

Cellulose acetate filter fibers were spread out into a swatch 0.25 inches by 3 inches and then coated with 250 mg of dialdehyde starch suspended in distilled water. The treated fibers were dried at 37 C overnight and then made into a tobacco cigarette using a tube cigarette maker. The smoke from one of each type of filter cigarette was then drawn through 3 mls of distilled water using a water-pipe smoking device which was constructed from a small (25 ml) glass Erlenmeyer flask attached to a vacuum source with an air flow rate of approximately 35 ml/min. 500 ul of each sample was added to 500 ul of each of the following solutions (1) 1% sulphanilic acid in 30% acetic acid (2) 0.1% naphthylamine in 30% acetic acid. The mixture was then incubated at 56 C. Samples were removed at 0, 10, 20 and 30 minutes and read a 540 nm using 620 nm as a reference value. Formation of color indicates the presence of nitrosamine compounds.

Figure 6:
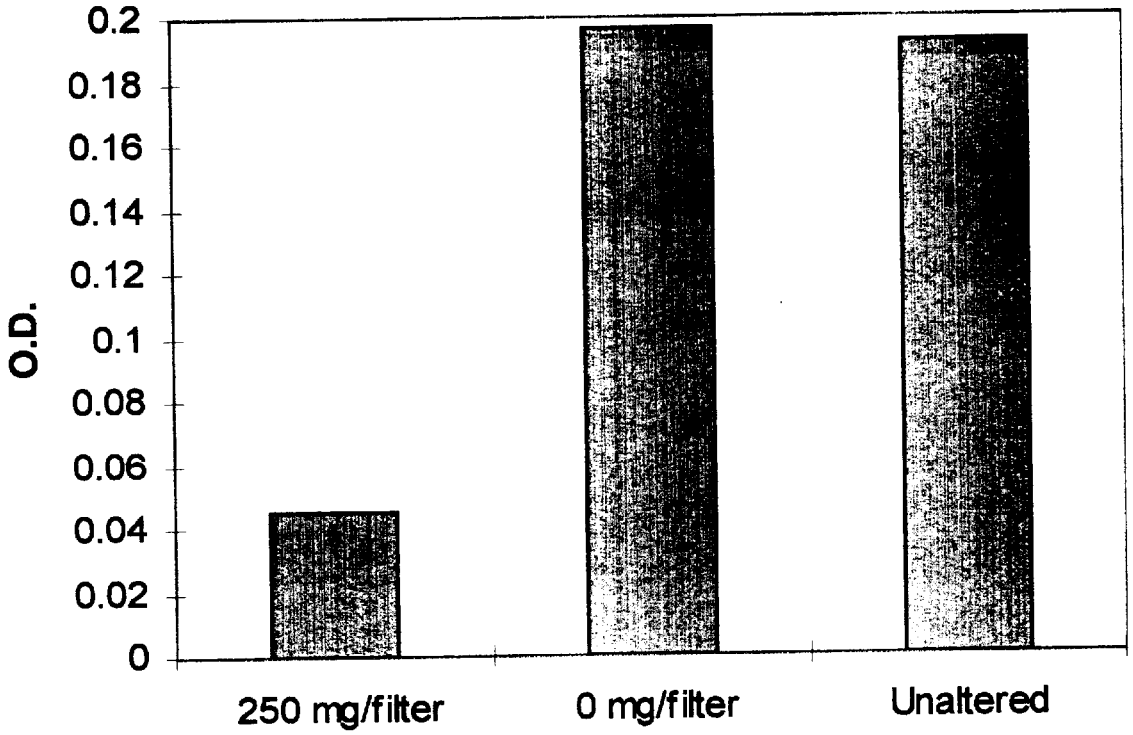
FIG. 6 depicts the removal of nitrosamines from tobacco smoke by an agent and device of the present invention.

FIG. 6 shows that 250 mg of the agent of the present invention diminished the level of nitrosamines in the tobacco smoke extract by several fold.

EXAMPLE 7

Taste Test

A double-blind taste test was performed on 12 individuals in an office environment in a large city. The subjects were asked to fill out a brief questionnaire inquiring about their age, years of smoking, daily usage and preferred brand. After answering these questions, the subjects then lit two cigarettes, one with the filter of the present invention comprising dialdehyde starch, and one with a regular filter. As they smoked the cigarettes side by side, they were asked to record which cigarette was preferred and to describe any differences perceived between the two.

The average age of the participants was 41 years, average duration of smoking 18.4 years, and each smoked on average 25.7 cigarettes per day. Eight of the twelve participants preferred the test cigarette with the dialdehyde starch filter over the control cigarette, and four individuals did not prefer one cigarette over the other.

This invention may be embodied in other forms or carried out in other ways without departing from the spirit or essential characteristics thereof. The present disclosure is therefore to be considered as in all respects illustrative and not restrictive, the scope of the invention being indicated by the appended Claims, and all changes which come within the meaning and range of equivalency are intended to be embraced therein.

It is to be understood that the devices of the invention is not limited to the description herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

Various publications in addition to the immediately foregoing are cited herein, the disclosures of which are incorporated by reference in their entireties.

What is claimed is:

1. A method for reducing the level of nucleophilic toxins present in air containing tobacco combustion products by passing said air through a filter element capable of removing nucleophilic toxins present in said air, said filter element comprising a polymer derivatized with aldehydic groups.

2. The method of claim 1 wherein said air comprises mainstream tobacco smoke and said smoke retains nicotine content and desirable flavor components after passage through said filter.

3. The method of claim 1 wherein said polymer is selected from the group consisting of periodate-oxidized cellulose, periodate-oxidized starch, periodate-oxidized agarose, periodate-oxidized partially-acetylated cellulose, and combinations thereof.

4. The method of claim 1 wherein said polymer derivatized with aldehydic groups is selected from the group consisting of dialdehyde starch, dialdehyde cellulose, and the combination thereof.

5. A method for reducing the level of nucleophilic toxins present in air containing tobacco combustion products by passing said air through a filter element capable of removing nucleophilic toxins present in said air, said filter element comprising an agent selected from the group consisting of activated ketones, non-polymeric anhydrides, active esters, hematein, and combinations thereof.

6. A method for reducing the level of nucleophilic toxins present in air containing tobacco combustion products by passing said air through a filter element capable of removing nucleophilic toxins present in said air, said filter element comprising an agent selected from the group consisting of adenosine dialdehyde, inosine dialdehyde, o-phthaldialdehyde, ethylene dioxybis(3-benzaldehyde), and combinations thereof.

7. The method of claim 4 wherein said toxin-removing agent is dialdehyde starch.

8. The method of claim 5 wherein said activated ketone toxin-removing agent is selected from the group consisting of α-dicarbonyl compounds, β-dicarbonyl compounds, γ-dicarbonyl compounds, and α,β-unsaturated ketones.

9. The method of claim 8 wherein said α-dicarbonyl toxin-removing agent is selected from the group consisting of camphorquinone, ninhydrin, phenylglyoxal, alloxan, and combinations thereof.

10. The method of claim 8 wherein said β-carbonyl toxin-removing agent is selected from the group consisting of 5,5-dimethyl-1,3-cyclohexanedione, dibenzoylmethane, and the combination thereof.

11. The method of claim 8 wherein said γ-carbonyl toxin-removing agent is selected from the group consisting hydrindantin, succinylphenone, and combinations thereof.

12. The method of claim 8 wherein said α,β-unsaturated ketone toxin-removing agent is selected from the group consisting of 1,2-dibenzoylethylene, curcumin, dicinnamalacetone, and combinations thereof.

13. The method of claim 5 wherein said anhydride toxin-removing agent is selected from the group consisting of 2-dodecen-1-ylsuccinic anhydride, bicyclo(2,2,2)oct-7-ene-2,3,5,6-tetracarboxylic dianhydride, diethylenetriaminepentaacetic anhydride, ethylenediaminetetraacetic dianhydride, (+)-diacetyl-1-tartaric anhydride, and combinations thereof.

14. The method of claim 5 wherein said activated ester toxin-removing agent is selected from the group consisting of bicyclo(2,2,2)oct-7-ene-2,3,5,6-hydroxysuccinimide ester, N-α-t-butoxycarbonyl-L-alanine-N-hydroxysuccinimide ester, N-α-t-butoxycarbonyl-L-glutamic-α-benzyl ester-γ-N-hydroxysuccinimide ester, ε-t-butoxycarbonyl-aminocaproic acid N-hydroxysuccinimide ester, N-hydroxysuccinimidyl-activated agarose, 6-aminohexyl N-hydroxysuccinimide ester-activated agarose, and combinations thereof.

15. A device for reducing the level of toxins present in air containing tobacco combustion products wherein said device comprises a filter element which air passes therethrough, said filter element capable of removing nucleophilic toxins present in said air, said filter element comprising a polymer derivatized with aldehydic groups.

16. The device of claim 15 wherein said device filters mainstream tobacco smoke and said smoke retains nicotine content and desirable flavor components after passage through said filter.

17. The device of claim 15 wherein said polymer is selected from the group consisting of periodate-oxidized cellulose, periodate-oxidized starch, periodate-oxidized agarose, periodate-oxidized partially-acetylated cellulose, and combinations thereof.

18. The device of claim 15 wherein said polymer derivatized with aldehydic groups is selected from the group consisting of dialdehyde starch, dialdehyde cellulose, and the combination thereof.

19. A device for reducing the level of toxins present in air containing tobacco combustion products wherein said device comprises a filter element which air passes therethrough, said filter element capable of removing nucleophilic toxins present in said air, said filter element comprising an agent selected from the group consisting of activated ketones, non-polymeric anhydrides, active esters, hematein, and combinations thereof.

20. A device for reducing the level of toxins present in air containing tobacco combustion products wherein said device comprises a filter element which air passes therethrough, said filter element capable of removing nucleophilic toxins present in said air, said filter element comprising an agent selected from the group consisting of adenosine dialdehyde, inosine dialdehyde, o-phthaldialdehyde, ethylene dioxybis(3-benzaldehyde), and combinations thereof.

21. The device of claim 18 wherein said toxin-removing agent is dialdehyde starch.

22. The device of claim 19 wherein said activated ketone toxin-removing agent is selected from the group consisting of α-dicarbonyl compounds, β-dicarbonyl compounds, γ-dicarbonyl compounds, and α,β-unsaturated ketones.

23. The device of claim 22 wherein said α-dicarbonyl toxin-removing agent is selected from the group consisting of camphorquinone, ninhydrin, phenylglyoxal, alloxan, and combinations thereof.

24. The device of claim 22 wherein said γ-carbonyl toxin-removing agent is selected from the group consisting hydrindantin, succinylphenone, and combinations thereof.

25. The device of claim 22 wherein said α,β-unsaturated ketone toxin-removing agent is selected from the group consisting of 1,2-dibenzoylethylene, curcumin, dicinnamalacetone, and combinations thereof.

26. The device of claim 19 wherein said anhydride toxin-removing agent is selected from the group consisting of 2-dodecen-1-ylsuccinic anhydride, bicyclo(2,2,2)oct-7-ene-2,3,5,6-tetracarboxylic dianhydride, diethylenetriaminepentaacetic anhydride, ethylenediaminetetraacetic dianhydride, (+)-diacetyl-1-tartaric anhydride, and combinations thereof.

27. The device of claim 19 wherein said activated ester toxin-removing agent is selected from the group consisting of bicyclo(2,2,2)oct-7ene-2,3,5,6-hydroxysuccinimide ester, N-α-t-butoxycarbonyl-L-alanine-N-hydroxysuccinimide ester, N-α-t-butoxycarbonyl-L-glutamic-α-benzyl ester-γ-N-hydroxysuccinimide ester, ε-t-butoxycarbonyl-aminocaproic acid N-hydroxysuccinimide ester, N-hydroxysuccinimidyl-activated agarose, 6-aminohexyl N-hydroxysuccinimide ester-activated agarose, and combinations thereof.

28. The device of claim 15 used to filter air in a tobacco smoke-generating device or in a tobacco smoke-containing environment selected from the group consisting of a cigarette, free-standing cigarette filter, pipe, cigar, air ventilation filter, gas mask, and face mask.

29. A method for preventing the absorption into the body of nucleophilic toxins present in smokeless tobacco without affecting the absorption of nicotine by incorporating into said tobacco an agent capable of binding nucleophilic toxins present therein, said agent selected from the group consisting of a polymer derivatized with aldehydic groups, adenosine dialdehyde, inosine dialdehyde, o-phthaldialdehyde, ethylene dioxybis(3-benzaldehyde), activated ketones, anhydrides, active esters, hematein, and combinations thereof.

30. A method for reducing the level of nucleophilic toxins present in mainstream tobacco smoke derived from a tobacco-containing smoking device while retaining nicotine delivery by incorporating into the tobacco of said device an agent capable of binding nucleophilic toxins present in said tobacco, said agent selected from the group consisting of a polymer derivatized with aldehydic groups, adenosine dialdehyde, inosine dialdehyde, o-phthaldialdehyde, ethylene dioxybis(3-benzaldehyde), activated ketones, anhydrides, active esters, hematein, and combinations thereof.

* * * * *